US010384224B1

(12) United States Patent
Moignard et al.

(10) Patent No.: US 10,384,224 B1
(45) Date of Patent: Aug. 20, 2019

(54) DUAL PUMP DISPENSING SYSTEM

(71) Applicant: ELC Management LLC, Melville, NY (US)

(72) Inventors: Julien Moignard, New York, NY (US); Robert Michael Crescas, Madison, NJ (US); Lorraine Drake, New York, NY (US); Thomas Edward Owen, Montaul, NY (US); Janet Pardo, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 15/898,575

(22) Filed: Feb. 17, 2018

(51) Int. Cl.
*B05B 11/00* (2006.01)

(52) U.S. Cl.
CPC ..... *B05B 11/3084* (2013.01)

(58) Field of Classification Search
CPC .. B05B 11/3084; B05B 11/3085; F04B 13/02; B65D 83/68; B65D 83/682; B65D 83/685; B65D 83/687
USPC ..... 222/135
See application file for complete search history.

(56) References Cited

U.S. PATENT DOCUMENTS 3,416,709 A * 12/1968 Shultz ..... B01F 5/0256 222/145.6
3,704,814 A * 12/1972 Ruscitti ..... B65D 83/682 222/136
4,595,127 A * 6/1986 Stoody ..... B05B 7/2421 222/135
5,339,990 A * 8/1994 Wilder ..... B05B 11/3001 222/135
5,439,141 A * 8/1995 Clark ..... B05B 11/0056 222/136
5,472,119 A * 12/1995 Park ..... B05B 11/3081 222/136
5,711,457 A * 1/1998 Wanbaugh ..... B05B 11/3011 222/136
5,890,624 A * 4/1999 Klima ..... B05B 11/00 222/82
5,918,771 A * 7/1999 van der Heijden ... B05B 7/0025 222/136
2004/0251274 A1* 12/2004 Ponton ..... B05B 11/3083 222/134
2005/0127100 A1* 6/2005 Reggiani ..... A45D 40/24 222/135
2006/0054633 A1* 3/2006 Brugger ..... B05B 11/0054 222/94

(Continued)

FOREIGN PATENT DOCUMENTS

EP 1407827 A2 4/2004
KR 20-2013-0006909 U 12/2013

OTHER PUBLICATIONS

ISR and Written Opinion of ISA (KR)—in counterpart PCT/US/2019/017295—dated May 24, 2019.

*Primary Examiner* — Benjamin R Shaw
(74) *Attorney, Agent, or Firm* — Peter Giancana

(57) ABSTRACT

A dual pump dispensing system that features a reservoir within a reservoir arrangement. Each reservoir holds a different product, and has a separate pump dispenser. The pump dispensers are housed in a cartridge so that much of those mechanisms are not visible to the consumer. The pumps are sized to dose a specified ratio of each product, and the products are only mixed at the exit orifice of the nozzle or on the skin.

8 Claims, 8 Drawing Sheets

(56) References Cited

U.S. PATENT DOCUMENTS

| | | | | |
|---|---|---|---|---|
| 2012/0241474 | A1* | 9/2012 | Dennis | B05B 15/30 222/137 |
| 2012/0241475 | A1* | 9/2012 | Dennis | B05B 11/3009 222/137 |
| 2015/0344214 | A1* | 12/2015 | Yamaguchi | B65D 83/38 222/95 |
| 2016/0228899 | A1* | 8/2016 | Gonzalez | B05B 11/3084 |
| 2016/0228900 | A1* | 8/2016 | Gonzalez | B05B 11/3084 |

* cited by examiner

DUAL PUMP DISPENSING SYSTEM

BACKGROUND

Cosmetic and personal care lotion dispensers that simultaneously dispense two different products are known. These generally use two product reservoirs in a side-by-side arrangement. These may be further differentiated depending on whether the system uses two separately functioning pumps, one for each reservoir, or one pump which draws products from both reservoirs. In the first case, the two products may not be mixed until they are dispensed onto an application surface, such as the skin. This type of system is preferred when the two products are reactive with each other, but should be prevented from reacting until the time of use. In the latter case, the products are mixed in the accumulator of the pump. Since there is always some product in the accumulator in between uses, it may be preferable if the two products are not reactive with each other. In either case, the side by side arrangement of the two reservoirs has a detrimental effect on the overall appearance of the product packaging. For example, clear glass or plastic reservoirs allow the consumer to see the two products and the two pump dispensers. This may not be desirable. Also, since both products are visible, both products have to have a finished appearance for the consumer market. Appearance is a quality that may have little to do with efficacy, but achieving a finished appearance does increase cost. On the other hand, the reservoirs could be opaque so that the products and multiple pump mechanisms are not visible, but then the design choices have been limited by the dual pump system, where the high-end appearance of a clear package may be preferred.

Objectives

A main objective of the present invention is to provide a dual pump dispensing system that simultaneously doses two different products in a specified volumetric ratio, so that the products do not mix until they are exiting the dispensing system. Another objective of the present invention is to provide a dual pump dispensing system that does not detract from the appearance of the product packaging. Another objective is to provide a dual pump dispensing system that affords new options for enhancing the appearance of the product packaging.

SUMMARY

The dual pump dispensing system of the present invention features a reservoir within a reservoir arrangement. Each reservoir holds a different product, and has a separate pump dispenser. The pump dispensers are housed in a cartridge so that much of those mechanisms are not visible to the consumer. The pumps are sized to dose a specified volumetric ratio of each product, and the products are only mixed at the exit orifice of the nozzle or on the skin.

Also described herein, is a kit that comprises a first reservoir of a first flowable product that is sealed with a non-dispensing closure. Separate from the first reservoir, the kit also comprises a cartridge that houses a second reservoir that contains a second flowable product. The second reservoir is fitted with a dual pump dispensing system, and is intended to be inserted into the first reservoir by a user or consumer.

DETAILED DESCRIPTION

Figure 1:
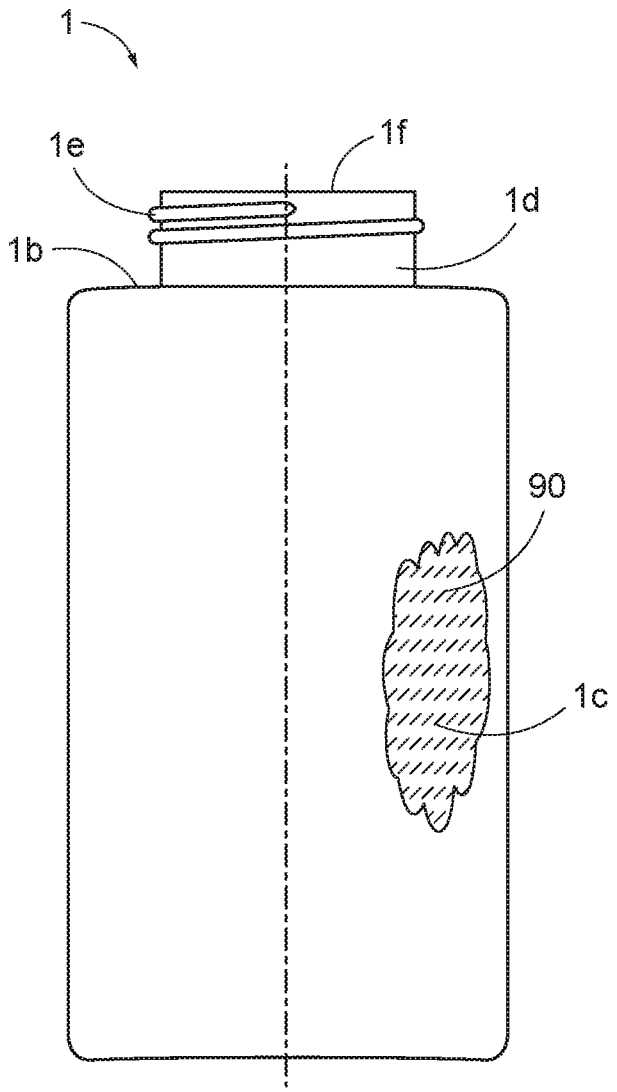
FIG. 1 depicts a container (1) that comprises a first reservoir (1*c*), shown by the cutaway.

A dual pump dispensing system according to embodiments of the present invention may comprise a container (1), a cartridge (10), a gasket (20), a first mechanical pump dispenser (30), a second mechanical pump dispenser (40), a cartridge cap (50), a collar (60), an actuator (70) and an overcap (80).

Container

Referring to FIG. 1, the container (1) is that part of the system that can be grasped in the hand of a user. The container comprises a bottom (1*a*), a top (1*b*) and a main or first reservoir (1*c*) for holding a first flowable product (90). The top (1*b*) of the container comprises a neck (1*d*) that has means for attaching a collar (60). For example, the neck of the container may have a screw threaded finish (1*e*). Access into the first reservoir is through an opening (1*f*) in the neck of the container. In general, all or a portion of the container may be transparent, translucent or opaque.

Cartridge

Figure 2A:
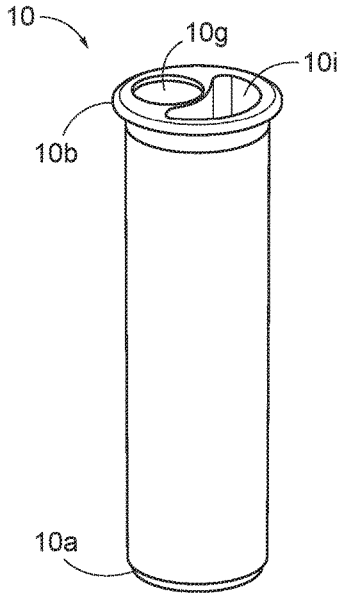
FIGS. 2A, 2B and 2C depict a cartridge (10) that comprises a second reservoir (10*c*)
Figure 2C:
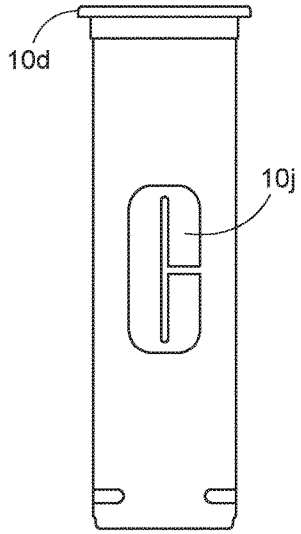
Figure 2B:
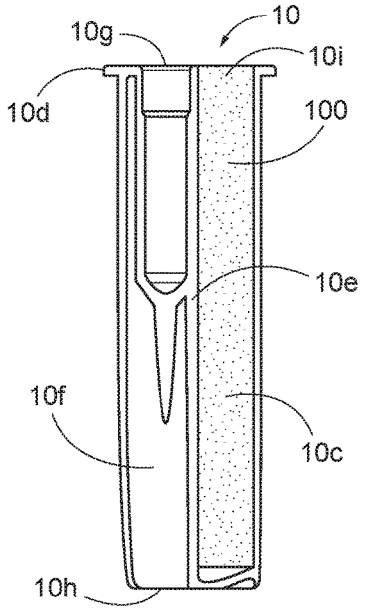

The dual pump dispensing system according to the present invention comprises a cartridge (10). As shown in FIGS. 2A, 2B and 2C, the cartridge is basically cylindrical, although that is not a strict requirement. The cartridge has a bottom (10*a*) and a top (10*b*). The bottom of the cartridge is inserted through the neck (1*d*) of the container (1), and extends down into product (90) located in the first reservoir (1*c*) of the container. The top of the cartridge features a flange (10*d*) that is supported by the top of the neck (1*d*). To effect a fluid tight seal, a gasket (20) may be disposed in between the top of the neck of the container and the flange of the cartridge (see FIG. 4).

The cartridge (10) further comprises an interior wall (10*e*) that divides the interior of the cartridge. One of the interior divisions of the cartridge is formed as a passageway (10*f*) that is opened at both ends of the cartridge. The opening at the top of the cartridge is the first top opening (10*g*). The opening at the bottom of the cartridge (10*h*) allows the first flowable product (90) to enter the passageway (10*f*). The other interior division of the cartridge is formed as a second reservoir (10*c*) that is closed at the bottom (10*a*) of the cartridge, while the opening at the top of the cartridge is the second top opening (10*i*). The second reservoir is for holding a second flowable product (100).

Figure 9:
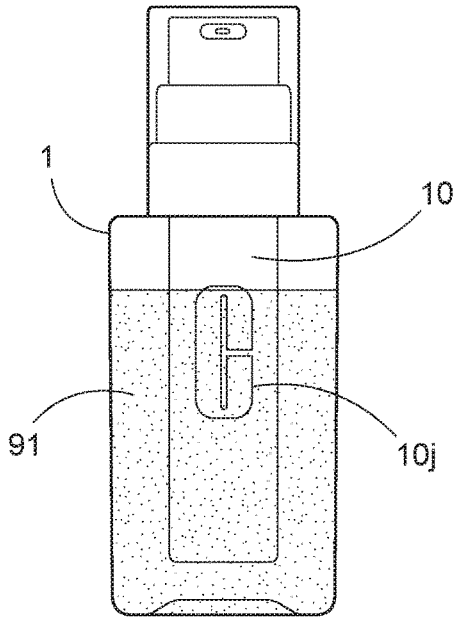
FIG. 9 depicts an embodiment where the container (1) and first flowable product (90) are clear, so that the cartridge (10) is visible inside the container.

An outer surface of the cartridge may optionally comprise a logo or other decorative element (10*j*; see FIG. 9). This feature will be particularly relevant to certain embodiments of the invention described below.

Two Mechanical Pump Dispensers

Figure 3:
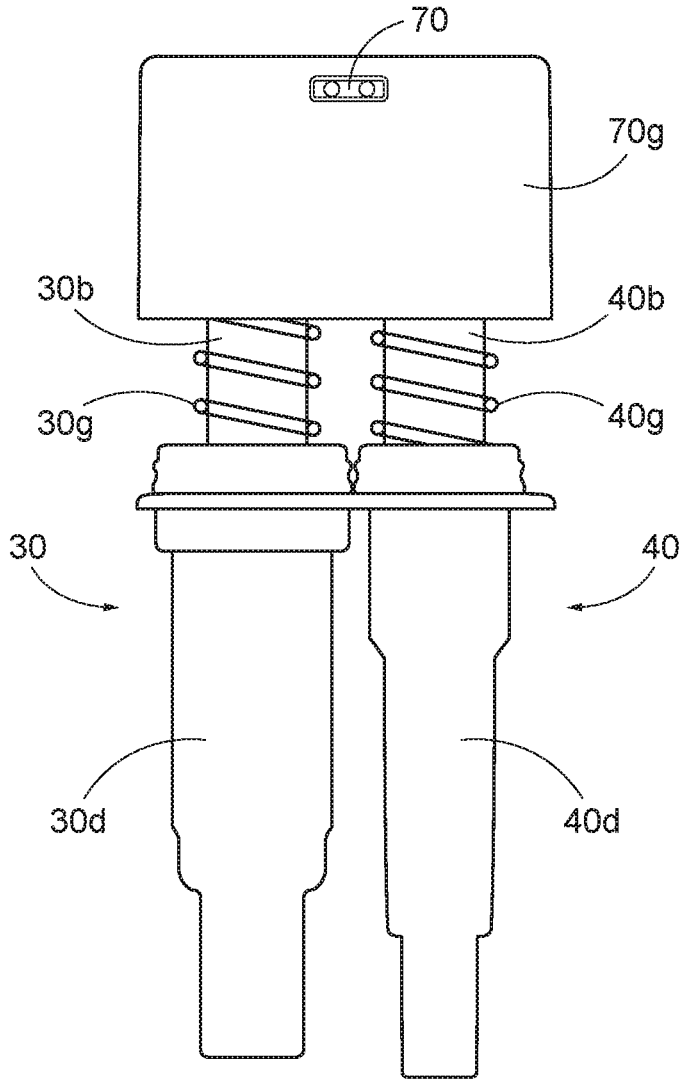
FIG. 3 is a depiction of a side-by-side arrangement of the first and second pump dispensers (30, 40) and actuator (70).
Figure 4:
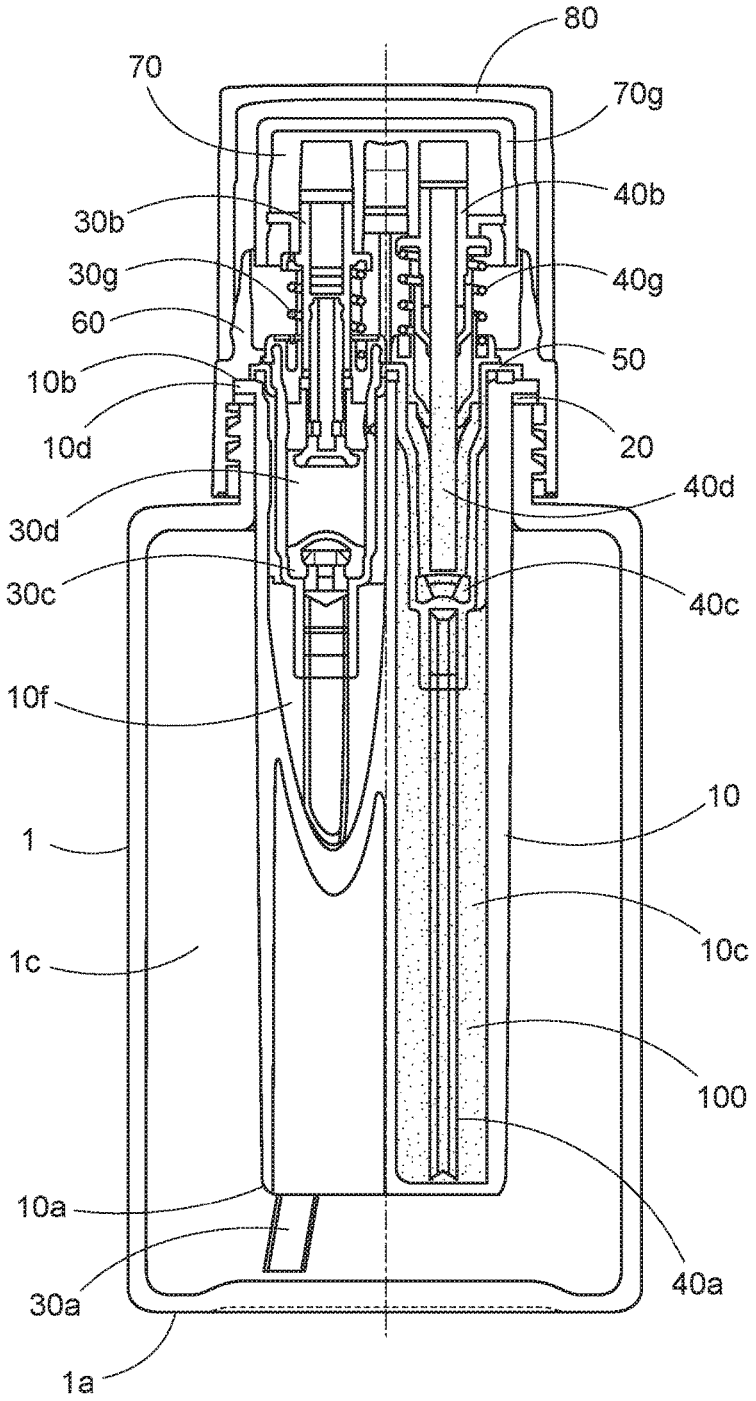
FIG. 4 is a cross sectional view of a dual pump dispensing system according to the present invention.

The dual pump dispensing system according to the present invention comprises two mechanical pump dispensers (hereinafter, the first pump (30) and the second pump (40)). Referring to FIGS. 3 and 4, both pumps comprise components that are well known to persons skilled in the art, such as dip tubes (30*a*, 40*a*), upper stems (30*b*, 40*b*), check valves (30*c*, 40*c*), accumulators (30*d*, 40*d*), and springs (30*g*, 40*g*), as well as pistons and lower stems.

The first pump (30) is inserted through the first top opening (10*g*) of the passageway (10*f*) of the cartridge (10), so that much of the first pump sits in the passageway. The upper stem (30*b*) of the first pump, however, rises above the top (10*b*) of the cartridge, and the free end of the dip tube (30*a*) of the first pump extends out the bottom (10*a*) of the cartridge into the first reservoir (1*c*) of the container (1) to a location that is near the bottom (1*a*) of the container. The first pump draws product (90) from the first reservoir through the dip tube (30*a*), and passes it on to the upper stem (30*b*) in the usual manner of lotion pump dispensers.

The second pump (40) is inserted through the second top opening (10*i*) of the second reservoir (10*c*) of the cartridge (10), so that much of the second pump sits in the second reservoir. The upper stem (40*b*) of the second pump, however, rises above the top (10*b*) of the cartridge, and the free end of the dip tube (40*a*) of the second pump extends toward the closed portion of the bottom (10*a*) of the cartridge. The second pump draws product (100) from the second reservoir of the cartridge through the dip tube (40*a*) and passes it on to the upper stem (40*b*) in the usual manner of lotion pump dispensers.

One of the challenges to be overcome in developing commercially acceptable embodiments of the present invention was how to keep the diameter of the cartridge (10) small while still being able to fit two functioning mechanical pump dispensers into the cartridge. The cartridge outer diameter had to be as small as possible so that the opening (1*f*) in the neck (1*c*) of the container (1) could be close to what is typical for products in the personal care field. For example, in various embodiments of the invention, we reduced the cartridge outer diameter to about 23 mm to fit into a container opening of less than 24 mm.

Cartridge Cap

Figure 5A:
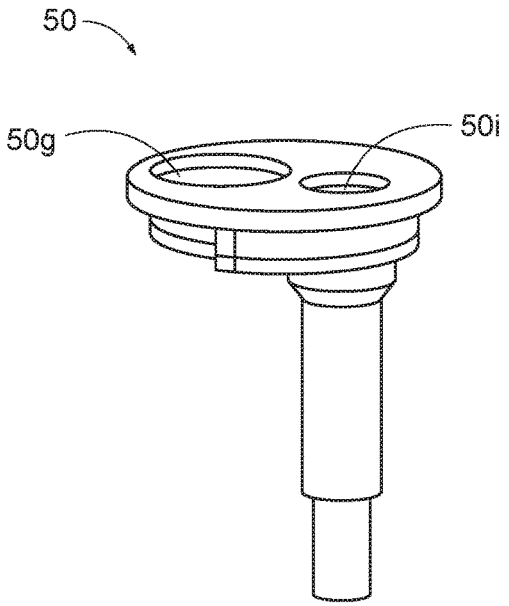
FIG. 5A is a perspective view of a cap (50) for the cartridge (10) which is integrally molded with the accumulator (40*d*) of the second pump dispenser (40).
Figure 5B:
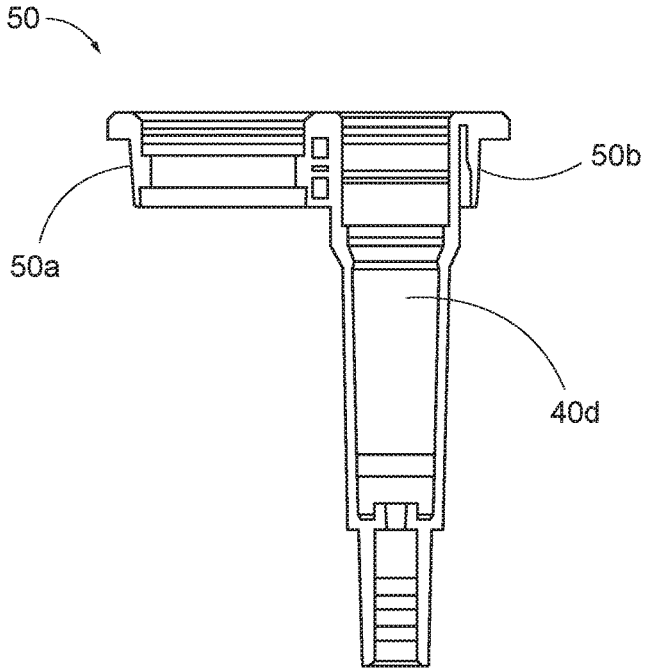
FIG. 5B is a cross sectional view of the same.

Optionally, the top of the cartridge (10) is fitted with a cartridge cap (50, see FIGS. 5A and 5B). On the bottom of the cartridge cap are first and second vertical walls (50*a*, 50*b*), the shapes of which match the shapes of the corresponding first and second openings (10*g* or 10*i*) at the top of the cartridge. The vertical walls fit snugly into the openings in the top of the cartridge, sufficiently tight to retain the cartridge cap in the cartridge. Passing through the cartridge cap are first and second openings (50*g*, 50*i*), each one surrounded by one of the vertical walls (50*a*, 50*b*). The accumulators (30*d*, 40*d*) of the first and second pumps (30, 40) pass through the two openings of the cartridge cap, which are shaped and sized to fit snugly around the accumulators, thus providing stability to the two pumps. Optionally, the accumulator of one or both of the pumps can be integrally molded with the cartridge cap. For example, in FIG. 5B, the accumulator (40*d*) of the second pump (40) is shown as being integrally molded with the cartridge cap (50), while the accumulator (30*d*) of the first pump (30) is intended to be inserted through the first opening (50*g*) of the cartridge cap.

Collar

Figure 6A:
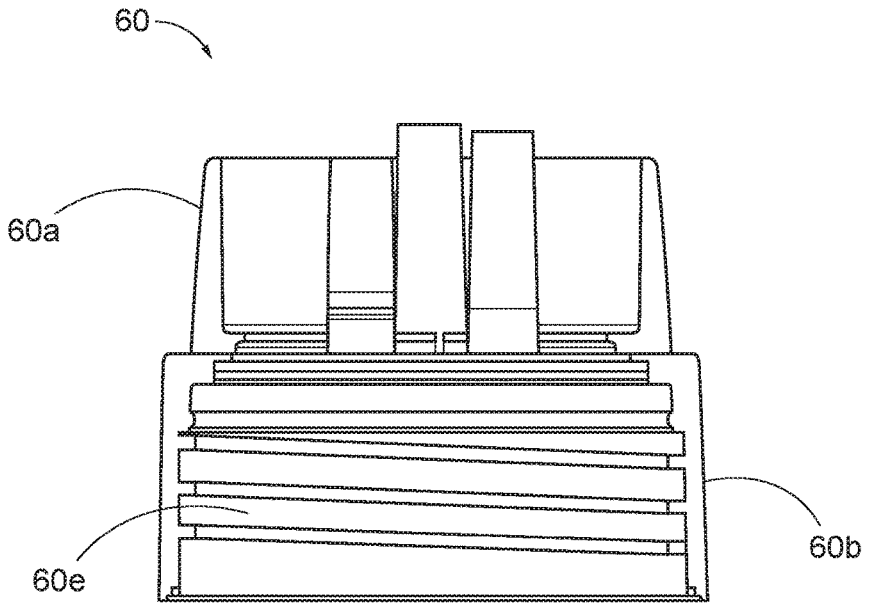
FIG. 6A is an elevation and cross sectional view of a collar (60) that attaches to the container (1).
Figure 6B:
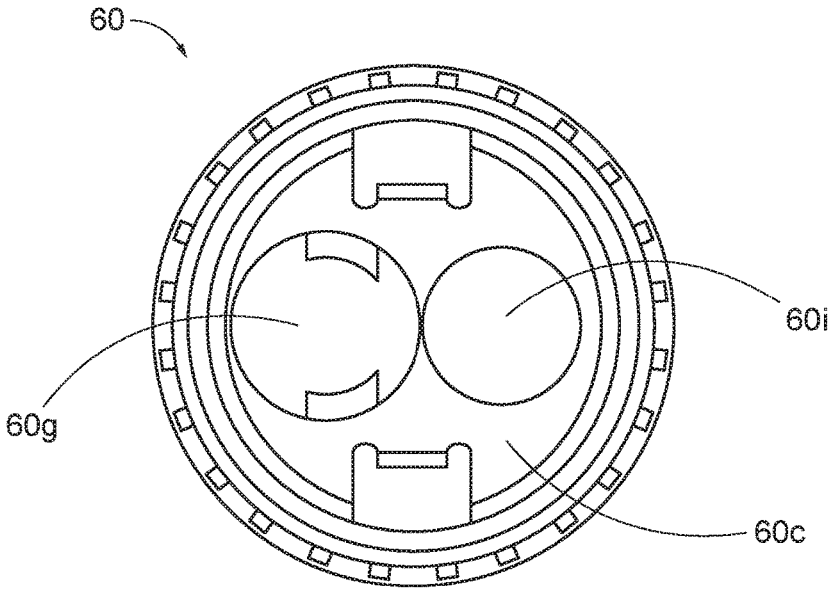
FIG. 6B is a bottom view of the same.

A collar (60), as shown in FIGS. 6A and 6B, is comprised of an upper circumferential wall (60*a*) and a lower circumferential wall (60*b*), separated by a base (60*c*). The base has first and second openings (60*g*, 60*i*) that correspond to the first and second top openings (10*g*, 10*i*) of the cartridge. The flange (10*d*) at top of the cartridge (10) is received into the collar (60), against the underside of the base (60*c*), and secured there with a friction fit, locking tabs or some other method suitable for securing plastic components together. The first and second openings (60*g*, 60*i*) in the base, the first and second top openings (10*g*, 10*i*) of the cartridge, and, if present, the first and second openings (50*g*, 50*i*) of the cartridge cap must respectively align, so as to allow the upper stems (30*b*, 40*b*) of the two pumps (30, 40) to protrude through the base. When the second mechanical pump dispenser is seated in the second reservoir, and the flange (10*d*) of the cartridge (10) is secured into the collar (60), then the second flowable product is effectively sealed off from the environment, and maintained in a fresh and stable condition.

The inner surface of the lower circumferential wall (60*b*) comprises screw threads (60*e*) that are designed to interact with the threaded finish (1*e*) of the neck (1*d*) of the container (1). This threaded engagement secures the cartridge with the two pumps onto the container (1). When the collar is fully screwed down onto the container neck, then the first flowable product is effectively sealed off from the environment, and maintained in a fresh and stable condition.

Actuator

Figure 7A:
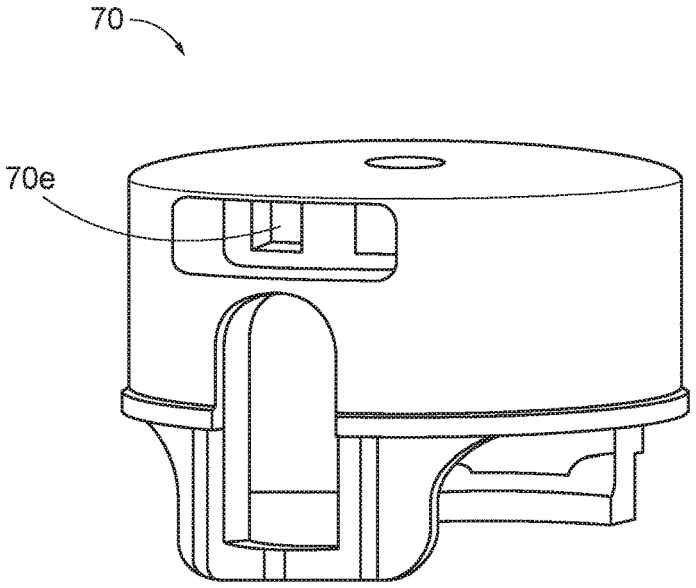
FIG. 7A is a perspective view of an actuator (70).
Figure 7B:
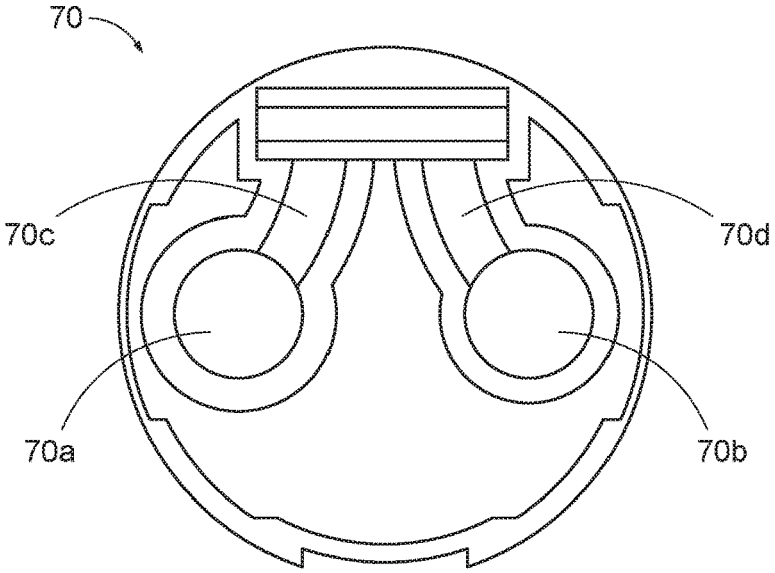
FIG. 7B is a bottom view of the same.

As noted, the two upper stems (30*b*, 40*b*) of the two pumps (30, 40) protrude through the collar (60). A single actuator (70, see FIGS. 7A and 7B) comprises two inlet ports (70*a*, 70*b*). Each port is able to receive one of the upper stems. Two channels (70*c*, 70*d*) lead from the inlet ports to at least one (one or two) exit orifices (70*e*) of the actuator. If there is only one exit orifice, then the two channel merge into one just before reaching the exit orifice, and the two flowable products (90, 100) begin to be mixed in the actuator. Alternatively, if there are two exit orifices, then each channel leads to one exit orifice, and the two flowable products do not mix until completely outside of the dispensing device; on the skin of a user, for example. An overshell (70*g*) may be used as a decorative element for the actuator or to provide a tactile element.

Overcap

The outer surface of the upper circumferential wall (60*a*) of the collar (60) provides a surface for securing an overcap (80) by friction fit. The overcap may be used to protect the actuator (70) and to give a more finished appearance to the package. The overcap may be transparent, translucent or opaque.

Two Flowable Products

A first flowable product (90) is housed in the first reservoir (1*c*) of the container (1). A second flowable product (100) is housed in the second reservoir (10*c*) of the cartridge (10). Preferred flowable products are viscous, excluding, for example, powder products. Preferred flowable products will typically be lotions or creams that are of sufficiently low viscosity that they can be pumped by the first and second mechanical pump dispensers (30, 40). With this dispensing system, a single push of the actuator (70) causes a single dose of two products (90, 100) to be dispensed in a defined volumetric ratio. In the personal care field, lotion pump dispensers of various dosages are available. Such pumps typically dispense from about 25 μL to about 500 μL of product per dose. Therefore, by proper design or selection of the pump dispensers, the volumetric ratio of a single dose of dispensed products may range from about 1:1 to about 20:1, as needed, to ensure a complete reaction of the dispensed products, or to ensure a particular consumer experience or benefit. Examples of useful product ratios include those from 1:1 to 20:1, preferably 5:1 to 20:1, or more preferably from 5:1 to 15:1, and even more preferably from 5:1 to 10:1. Generally, the second mechanical pump dispenser (40), which draws from the second reservoir (10*c*) located in the cartridge (10), will be the smaller dosing pump, since this pump draws from the smaller of the two reservoirs. Likewise, the first pump (30) will be the larger dosing pump, since this pump draws from the larger first reservoir (1*c*). Optionally, the first and second reservoirs will be filled in the same ratio as the dosing ratio of the two pumps, so that both reservoirs are depleted at about the same time.

The two flowable products (90, 100) may be inert with respect to each other, but a significant advantage of the invention is that two products, that would otherwise react with each other, can be separated, and not mixed until the time of use, thus ensuring efficacy and freshness.

Another significant advantage of the invention is the ability to fill the first reservoir (1*c*) with a primary personal care product (90) that provides a general benefit for skin or hair, and to fill the second reservoir (10*c*) with a secondary personal care product (100) that has specific skin care activity to address one or more specific needs. For example, the first reservoir may be filled with a popular skin moisturizer, while the second (cartridge) reservoir holds a product that has one or more active ingredients for treating lines and wrinkles, or uneven skin tone, or uneven skin texture, or an anti-irritant product or an fatigue product, etc. Alternatively, the first reservoir may be filled with the same popular skin moisturizer, while the second (cartridge) reservoir holds a product that has one or more active ingredients for cleansing, toning, treating acne, preventing sun damage, providing after-sun treatment, etc. Thus, the present invention permits an easy, inexpensive way for a consumer to try one "hero" product in combination with many other skin benefit products, for an added advantage. From a business perspective, a marketer is enabled to present a single primary product in a number of variations according to the number of secondary products. The consumer benefits from the convenience of a ready to use combination that requires only one purchase.

The first time that a dual pump dispenser of the present invention is used, several strokes will be required to prime the two mechanical pump dispensers (30, 40). Optionally, and by design, the second mechanical pump dispenser may require more strokes to prime than the first mechanical pump dispenser. This will ensure that that the active ingredient in the second reservoir (10*c*) is not dispensed by itself, before the moisturizer in the first reservoir (1*c*). This will be advantageous when the second (cartridge) reservoir contains a concentrated form of one or more ingredients that might irritate the skin in undiluted form. For example, the first mechanical pump dispenser (30) may, by design, require 1-6 strokes to prime, while the second mechanical pump dispenser (40) will require 6-10 strokes to prime.

As noted above, the first reservoir (1*c*) and the second reservoir (10*c*) may be filled in the same ratio as the dosing ratio of the two mechanical pump dispensers (30, 40), so that both reservoirs are depleted at about the same time. However, sometimes it will be advantageous to make sure that second reservoir empties before the first reservoir. For example, when the second flowable product (100) in the second reservoir contains a concentrated form of one or more ingredients that might irritate the skin in undiluted form, then it will be desirable to ensure that that the second flowable product is used up before the first flowable product (90). This can be done by ensuring that the filling ratio of the first reservoir to the second reservoir exceeds the dosing ratio of the first mechanical pump dispenser to the second mechanical pump dispenser. This also guarantees that the concentrated product (100) of the second reservoir is always diluted in the first product, in a set ratio.

Kit

The present invention may also be implemented as a kit. Some embodiments of a kit (200) according to the invention comprise a container assembly (300) and a cartridge assembly (400). The container assembly comprises a container (1) of a first flowable product (90), wherein the container is provided with a non-dispensing closure, such as a screw threaded cap (110) that is sized to cooperate with the screw threaded finish (1*e*) of the neck (1*d*). When the cooperating threads are fully engaged, the cap seals off access (the opening 1*f*) to the first flowable product in the first reservoir (1*c*). The first flowable product is maintained in a fresh and stable condition for sale in a commercial environment.

Separately, the cartridge assembly (400) comprises a collar (60), cartridge (10) that is sized to fit into the opening (10 of the container (1), two mechanical pump dispensers (30, 40) with an actuator (70), as described above. The second reservoir holds a second flowable product (100). As noted above, when the second mechanical pump dispenser (40) is seated in the second reservoir (10*c*), and the flange (10*d*) of the cartridge is secured into the collar (60), then the second flowable product is effectively sealed off from the environment, and maintained in a fresh and stable condition for sale in a commercial environment. To protect the actuator (70) and for a finished appearance, an overcap (80) may be fitted onto the collar, as described above.

A consumer purchases a container assembly (300) of first flowable product (90), and a cartridge assembly (400) of second flowable product (100). It is possible then to give to the consumer a choice of one or more second flowable products to match with one or more first flowable products. After purchase, the consumer is intended to remove the non-dispensing closure (110) from the container (1), and insert the cartridge (10) into the first reservoir, and then to screw the collar (60) onto the screw threaded finish (1*e*) of the neck (1*d*).

A method of using a kit as described herein may comprise the steps of: removing the non-dispensing closure (110) from the container (1) of the container assembly (300), inserting the bottom (10*b*) of the cartridge (10) of the cartridge assembly (400) into the first reservoir (1*c*), screwing the collar (60) onto the screw threaded finish (1*e*) of the neck (1*d*), stroking the actuator (70) until a desired amount of both of the first and second flowable products (90,100) is dispensed from the actuator, and applying both products to the skin of a user, simultaneously.

Some Optional Features

Figure 8:
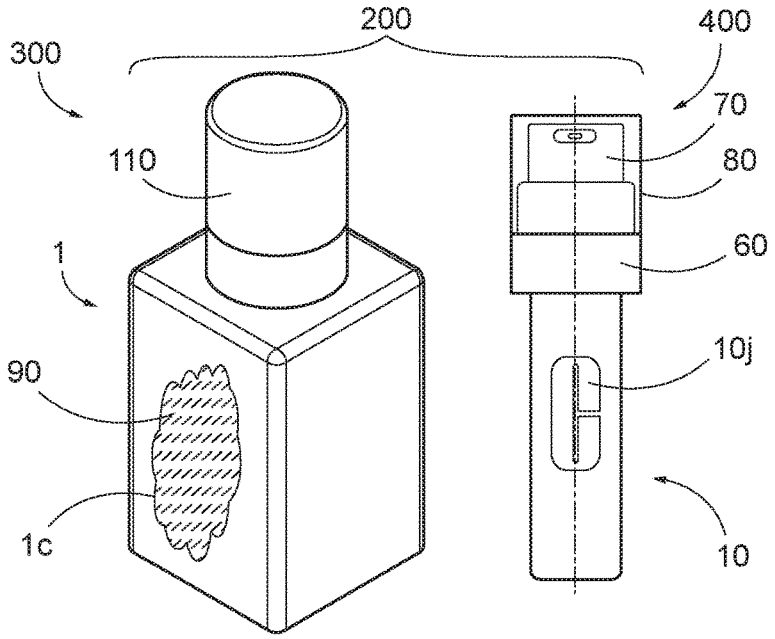
FIG. 8 is one embodiment of a kit (200) according to the present invention.

Referring to FIGS. 8 and 9, the outer surface of the cartridge may be any color or colors, and may optionally comprise a logo or other decorative element (10*j*). There are a number of situations in which this is advantageous. For example, when the cartridge is sold as part of a kit, then the outer surface of the cartridge is visible, and providing color, graphics and/or a logo to the outer surface of the cartridge will enhance product appeal in the marketplace.

Also, for example, when all or a portion of the container (1) is transparent and the reservoir (1*c*) contains a clear first flowable product (91), then the outer surface of the cartridge (10) will be visible through the container and first flowable product. In this situation, providing color, graphics and/or a logo (10*j*) will enhance product appeal in the marketplace. A particularly preferred version of this is when the container and first flowable product are of a very high clarity (see FIG. 9). Such a product might be an aqueous gel product, for example. In the personal care marketplace, high clarity in packaging and product almost always conveys an upscale or high end fashion appearance. The clarity of the container and first flowable product creates an opportunity to display a range of aesthetic elements to further enhance the visual interest and appeal.

What is claimed is:

1. A dual pump dispensing system that comprises:
- a container (1) that has:
  - a first reservoir (1*c*),
  - a neck (1*d*), and
  - access into the first reservoir through an opening (1*f*) in the neck of the container;
- a collar (60) that attaches to the neck (1*d*) of the container (1);
- a cartridge (10) that comprises:
  - a top (10*b*) that is secured into the collar (60);
  - a bottom (10*a*) that is inserted through the neck (1*d*) of the container (1) and that extends down into the first reservoir (1*c*) of the container;
  - an interior wall (10*e*) that divides the interior of the cartridge (10) into a passageway (10*f*) and a second reservoir (10*c*), wherein:
    - the passageway is opened at both ends of the cartridge, and
    - the second reservoir is closed at the bottom (10*a*) of the cartridge;
- a first mechanical pump dispenser (30) that sits in the passageway (10*f*) of the cartridge (10) and that has:
  - a dip tube (30*a*) that extends down into the first reservoir (1*c*), and
  - an upper stem (30*b*) that protrudes through the collar (60);
- a second mechanical pump dispenser (40) that sits in the second reservoir (10*c*) of the cartridge (10) and that has:
  - a dip tube (40*b*) that extends toward the bottom (10*a*) of the cartridge, and
  - an upper stem (40*b*) that protrudes through the collar (60);
- an actuator (70) that comprises two inlet ports (70*a*, 70*b*) that lead to at least one exit orifice (70*e*), wherein each inlet port is able to receive one of the upper stems (30*b*, 40*b*).

2. The dual pump dispensing system according to claim 1 further comprising a first flowable product (90) located in the first reservoir (1*c*), and a second flowable product (100) located in the second reservoir (10*c*).

3. The dual pump dispensing system according to claim 2 wherein a single push of the actuator (70) causes the first and second flowable products (90, 100) to be dispensed in a volumetric ratio of 5:1 to 20:1.

4. The dual pump dispensing system according to claim 2 wherein the actuator comprises two exit orifices.

5. The dual pump dispensing system of claim 2 wherein the outer surface of the cartridge (10) is visible through the container (1) and the first flowable product (90).

6. The dual pump dispensing system of claim 5 wherein the first flowable product (90) is a clear, aqueous gel product.

7. A kit (200) comprising a container assembly (300) and a cartridge assembly (400), wherein:
- the container assembly comprises:
  - a container (1) that has:
    - a first reservoir (1*c*) that holds a first flowable product (90),
    - a neck (1*d*),
    - access into the first reservoir through an opening (1*f*) in the neck (1*d*) of the container (1); and
    - a non-dispensing closure (110) that seals off the opening (1*f*) in the neck (1*d*) of the container (1);
- the cartridge assembly (400) comprises:
  - a collar (60) that is able to be attached to the neck (1*d*) of the container (1);
  - a cartridge (10) that that is sized to fit through opening (1*f*) of the neck (1*d*) of the container (1), comprising:
    - a top (10*b*) that is secured into the collar (60);
    - a bottom (10*a*);
  - an interior wall (10*e*) that divides the interior of the cartridge (10) into a passageway (10*f*) and a second reservoir (10*c*), wherein:
    - the passageway is opened at both ends of the cartridge (10),
    - the second reservoir is closed at the bottom (10*a*) of the cartridge, and
    - holds a second flowable product (100);
  - a first mechanical pump dispenser (30) that sits in the passageway (10*f*) of the cartridge (10) and that has:
    - a dip tube (30*a*) that extends down through the passageway (10*f*), and
    - an upper stem (30*b*) that protrudes through the collar (60);
  - a second mechanical pump dispenser (40) that sits in the second reservoir (10*c*) of the cartridge (10) and that has:
    - a dip tube (40*b*) that extends toward the bottom (10*a*) of the cartridge, and
    - an upper stem (40*b*) that protrudes through the collar (60);
  - an actuator (70) that comprises two inlet ports (70*a*, 70*b*) that lead to at least one exit orifice (70*e*), wherein each inlet port is able to receive one of the upper stems (30*b*, 40*b*).

8. A method of using a kit (200) according to claim 7, comprising the steps of:
- removing the non-dispensing closure (110) from the container (1) of the container assembly (300),
- inserting the bottom (10*b*) of the cartridge (10) of the cartridge assembly (400) into the first reservoir (1*c*),
- screwing the collar (60) onto the screw threaded finish (1*e*) of the neck (1*d*),
- stroking the actuator (70) until a desired amount of both of the first and second flowable products (90,100) is dispensed from the actuator, and
- applying both products to the skin simultaneously.

* * * * *